United States Patent [19]

Nidola

[11] Patent Number: 4,724,052

[45] Date of Patent: Feb. 9, 1988

[54] METHOD FOR PREPARING AN ELECTRODE AND USE THEREOF IN ELECTROCHEMICAL PROCESSES

[75] Inventor: Antonio Nidola, Milan, Italy

[73] Assignee: Oronzio de Nora Impianti Elettrochimici S.p.A., Milan, Italy

[21] Appl. No.: 905,914

[22] PCT Filed: Dec. 13, 1985

[86] PCT No.: PCT/EP85/00704

§ 371 Date: Sep. 29, 1986

§ 102(e) Date: Sep. 29, 1986

[87] PCT Pub. No.: WO86/03790

PCT Pub. Date: Jul. 3, 1986

[30] Foreign Application Priority Data

Oct. 10, 1985 [IT] Italy ..... 22529 A/85
Dec. 14, 1985 [IT] Italy ..... 24067 A/84

[51] Int. Cl.[4] ..... C25D 15/00
[52] U.S. Cl. ..... 204/16; 204/98
[58] Field of Search ..... 204/16, 23, 290 R, 290 F, 204/98

[56] References Cited

U.S. PATENT DOCUMENTS 4,496,442 1/1985 Okazaki ..... 204/129

*Primary Examiner*—T. M. Tufariello
*Attorney, Agent, or Firm*—Pollock, Vande Sande & Priddy

[57] ABSTRACT

The present invention concerns a method for preparing electrodes for use in electrochemical processes, said electrodes being constituted by a conductive support whereto an electrocatalytic coating is applied by galvanic deposition from a galvanic plating bath which additionally contains the groups IB, IIB, IIIA, IVA, VA, VIA, VIB, VIII of the periodic table.

The electrodes of the invention, obtainable according to the method of the invention, when used as cathodes in membrane or diaphragm chlor-alkali cells, exhibit low hydrogen overvoltages, constant with time, and are substantially immune to poisoning by iron, mercury or other metal impurities present in the alkaline solutions.

35 Claims, No Drawings

METHOD FOR PREPARING AN ELECTRODE AND USE THEREOF IN ELECTROCHEMICAL PROCESSES

DESCRIPTION OF THE INVENTION

The present invention relates to a method for preparing electrodes for use in electrochemical process, in particular for use in ion exchange membrane or permeable diaphragm cells for the electrolysis of alkali metal halides and more particularly as cathodes for hydrogen evolution in the presence of alkali metal hydroxide solutions.

Further, the present invention relates to the electrodes which are obtainable by the above method.

The main requisites for industrial cathodes are a low hydrogen overvoltage, which results in a reduction of energy consumption, as well as a suitable mechanical stability under the stresses which may occur during assembly or due to the turbulence of the liquids during operation.

Cathodes which fulfil the above requirements are constituted by a support of a suitable conductive material, such as iron, steel, stainless steel, nickel and alloys thereof, copper and alloys thereof, whereto an electrocatalytic conductive coating is applied.

Said electrocatalytic conductive coating may be applied, among various methods, by galvanic or electroless deposition of metal or metal alloys, which are electroconductive, but only partially electrocatalytic per se, such as nickel or alloys thereof, copper or alloys thereof, silver or alloys thereof, containing metals of the platinum group exhibiting low hydrogen overvoltages, these metals being present in the coating as a homogeneous phase, most probably as a solid solution.

As an alternative, the electrocatalytic coating may be obtained by galvanic or electroless deposition of an electrically conductive metal, only partially electrocatalytic per se, such as nickel, copper, silver and alloys thereof as aforementioned, which contains dispersed therein particles of an electrocatalytic material exhibiting a low overvoltage to hydrogen evolution. The electrocatalytic particles may consist of elements belonging to the group comprising: titanium, zirconium, niobium, hafnium, tantalum, metals of the platinum group, nickel, cobalt, tin, manganese, as metals or alloys thereof, oxides thereof, mixed oxides, borides, nitrides, carbides, sulphides, and are added and held in suspension in the plating baths utilized for the deposition.

Examples of electrodes having a coating containing dispersed electrocatalytic particles are illustrated in Belgian Pat. No. 848,458, corresponding to Italian patent application No. 29506 A/76, and in U.S. Pat. No. 4,465,580 which are incorporated herein by reference.

A particularly serious drawback connected to the use of the aforementioned electrodes, when used as cathodes in diaphragm or ion exchange membrane cells for alkali halides electrolysis, is constituted by the progressive poisoning of the catalytic surface caused by metal ions contained in the electrolyte, with the consequent gradual increase of the hydrogen overvoltage. The process efficiency results therefore negatively affected, which represents a particularly critical problem involving the necessity of periodical substitution of the cathodes.

Metal impurities which are normally responsible for the poisoning comprise Fe, Co, Ni, Pb, Hg, Sn, Sb or the like.

In the specific case of brine electrolysis in membrane cells, the metal impurities are more frequently represented by iron and mercury.

Iron impurities may have two origins:

a chemical one, from the anolyte, when the raw salt contains potassium ferrocyanide, added as anti-caking agent.

an electrochemical one, due to corrosion of the steel structure of the cathodic compartment and accessories thereof.

Mercury is found in the brine circuit after conversion of mercury cells to membrane cells.

As soon as these impurities, which are usually present in solution under a complex form, diffuse to the cathode surface, they are readily electroprecipitated to the metal state, so that a poorly electrocatalytic layer is built up in a relatively short time.

This catalytic aging, which depends on various factors such as the type of cathodic material (composition and structural), working conditions (temperature, catholyte concentration), and the nature of the impurity, results remarkable and irreversible soon after a short time of operation even in the presence of impurities concentrations of some parts per million.

In consideration of these substantial practical drawbacks, the inventor carefully studied the behaviour of many cathodes having electrocatalytic coatings with different compositions and surprisingly found that by adding certain compounds to the galvanic deposition baths, mentioned above and described in the technical and patent literature, electrodes are obtained which exhibit low hydrogen overvoltages which remain stable, or nearly stable, for extended periods of time also in the presence of impurities contained in the electrolysis solutions. In particular, it has been found that the electrocatalytic coating of the electrodes of the present invention renders them practically immune to poisoning by iron and mercury, by introducing additives in the galvanic bath utilized for preparing these coatings, as recited in the characterizing clause of claims 1 and 14 in a concentration range of 0.005 to 2,000 ppm. In the following description and in the examples, coatings obtained as described above will be identified as doped coatings; the elements, which promote the resistance of the coatings to poisoning, belong to the groups I B, II B, III A, IV A, V A, V B, VI A, VI B, VIII of the periodic table and they will be referred to as doping elements.

Preferably, the elements of the periodic table are silver, cadmium, mercury, thallium, lead, arsenic, vanadium, sulphur, molybdenum, platinum or palladium in case the electrocatalytic coating (b) comprises particles of electrocatalytic materials dispersed therein.

In case the electrocatalytic coating contains metals of the platinum group in a homogeneous phase the preferred elements of the periodic table are gold, cadmium, thallium, lead, tin, arsenic, vanadium, molybdenum, platinum or palladium.

The compounds of the above-mentioned elements for example may be oxides, sulfides, sulfates, thiosulfates, halides (especially chlorides), oxyhalides (especially oxychlorides), metal (especially alcali metal) salts of oxo acids, nitrates, mixed salts and complex salts.

For example, said compound may be selected from the group consisting of TlCl, $Pb(NO_3)_2$, $SnCl_2$, $As_2O_3$, $Sb_2O_3$, $Bi_2O_3$, $PtCl_4$, $PdCl_2$, $CuCl_2$, $AgCl(NH_3)_2$, $AuCl_3$, $Fe(NO_3)_2$, $(NH_4)_2SO_4$, $Hg(NO_3)_2$, $CdCl_2$, $VOCl_2$, $Na_2MoO_4$, $MoO_3$, $Na_2S_2O_3$, $Na_2S$, $Cd(NO_3)_2$, $Bi(NO_3)_3$.

Deposition of the electrocatalytic coating onto the support is carried out according to conventional techniques well-known to a person skilled in galvanotechnics. For example, the galvanic nickel-plating bath may be a Watt bath (nickel chloride and sulphate in the presence of boric acid or other buffering agent), a stabilized or un-stabilized sulphamate bath, a Weisberg bath, a nickel chloride bath, a nickel chloride and acetate bath and the like: according to the teachings of the aforementioned patents suitable quantities of soluble salts of platinum group metals are dissolved in the solution, or, as an alternative, suitable quantities of particles of an electrocatalytic material previously selected are held in suspension by stirring and, if necessary, by adding surfactants. As a typical example, the metal support is constituted by an expanded nickel sheet or fabric, the soluble salt of a platinum group metal is ruthenium trichloride, the electrocatalytic material, the particles of which are held in suspension, is ruthenium dioxide.

Obviously, in case the coating is based on copper, silver, alloys thereof or other metals or alloys, instead of nickel, galvanic or electroless baths based on said metals will be utilized.

The thickness of the electrocatalytic coating, the percentage of the platinum group metal present as a homogeneous phase in the coating or, as an alternative, the quantity and the size of the electrocatalytic particles dispersed in the coating are not critical per se, but are substantially defined on practical and economical basis: usually the coating thickness is comprised between 1 and 50 microns, the platinum group metal present as a homogeneous phase ranges from 0.1 to 50% by weight, the dispersed particles have an equivalent diameter of 0.01 to 150 microns and their quantity may vary between 1 and 50% by weight.

The present invention, with respect to the above mentioned process and to the teachings of the previously illustrated patent literature (Belgian Pat. No. 848,458, U.S. Pat. No. 4,465,580) is represented by the addition of suitable quantities of compounds of at least one of the aforementioned doping elements to the galvanic deposition bath, described above. By this addition the coating is found to contain varying quantities of doping elements: as illustrated in some of the following Examples, the concentration of doping elements may vary within ample limits depending on the conditions of deposition, particularly the current density, temperature, bath pH, at the same concentration of compounds of the doping elements in the deposition bath. However, the resistance to poisoning of the electrodes thus prepared, when operating as cathodes, appears to be completely independent from the variation of the concentration of the doping elements in the coating.

As regards the hindering action against poisoning and the chemical nature itself of the doping elements added to the coating (elemental state vs. oxidation state different from zero in finely divided dispersions of said compounds), a complete explanation is still difficult to state. It may be assumed that less noble doping elements, such as Zn, Cd, V, are present as hydrated oxides or as basic salts, causing a sharp modification of the wettability and adhesion characteristics between the coating surface and the mercury droplets and iron microcrystals which are formed during operation of the electrode as cathode in polluted alkali solutions. In fact, due to the presence, from the beginning, of metals of the platinum group or of electrocatalytic particles in the growing coating, the deposition potential is not sufficiently cathodic to allow for the discharge of the doping element to the metal state.

Therefore, the coatings according to the present invention are substantially different from the conventional coatings illustrated in the prior art wherein, for example, zinc is present in large amounts as a metal and is subject to leaching in order to provide for a higher porosity and increased active surface.

As regards nobler doping elements, in particular Pt and Pd, the addition of extremely small quantities (0.01 ppm in the galvanic bath and even less in the coating) is sufficient to quite efficiently inhibit poisoning by iron and mercury.

These controlled additions constitute the present invention. In fact, electrocatalytic coatings containing high quantities of metals of the platinum group, or, as a limit case, exclusively consisting of said elements, are readily deactivated when utilized as cathodes in polluted alkali solutions (as regards Ru and Pt refer to D. E. Grove, Platinum Metals Rev. 1985, 29(3), 98–106).

The electrodes of the invention may be used in an electrolytic cell for the electrolysis of alcali metal halides, wherein gas- and liquid-permeable anodes and cathodes are separated by a permeable diaphragm or an ion-exchange membrane, which membrane is substantially impermeable to electrolyte flow, said cell having as the catholyte an alkali metal hydroxide solution, even polluted by iron and/or mercury.

The most meaningful examples are reported in the following part of the description to further illustrate the invention, which however is not intended to be limited thereto. For example, in the following examples the coating is formed by galvanic deposition but it is evident to a person skilled in the art that electroless deposition may be resorted to as well.

EXAMPLE 1

Various 25 mesh samples made of nickel wire having a diameter of 0.1 mm were steam degreased and rinsed in a 15% nitric acid solution for about 60 seconds. Utilizing the nickel samples as substrates, electrodeposition was carried out from a plating bath having the following composition:

| | |
|---|---|
| nickel sulphate | 210 g/l |
| nickel chloride | 60 g/l |
| boric acid | 30 g/l |
| ruthenium oxide po | 4 g/l (as a metal) |
| additives (types and concentration, see Table I) | |

The bath temperature was about 50° C., and the current density 100 A/square meter. The bath contained ruthenium oxide particles having an average diameter of the particles of about 2 micrometers, with a minimum diameter of 0.5 micrometers and a maximum diameter of 5 micrometers.

The powder was held in suspension by mechanical stirring and electrodeposition was carried out for about 2 hours.

The thickness of the deposited coating was about 25 micrometers and about 10 percent of the coating volume was constituted by ruthenium oxide particles uniformly dispersed in the nickel matrix. Oxide particles only partially covered by nickel, whose surface appeared dendritic, were found onto the surface of the coating.

The potentials of the cathodes thus obtained were then measured as a function of time, at 90° C. and at 3 kA/square meter, in alkali solutions of 33 percent NaOH polluted respectively by 50 ppm of iron and 10 ppm of mercury. The detected values were then compared with those characteristic of a cathode prepared from a bath without immunizing additives.

The results, reported in Table 1, outline the substantial effect of catalytic aging caused in particular by mercury onto the un-doped cathode: the catalytic aging is substantially eliminated or remarkably reduced for the cathodes prepared with nickel-plating bath whereto the aforementioned compounds of the doping elements were added.

In this example, as well as in the following examples, the concentrations of the various additives in the plating bath, and of iron and mercury in the 33% NaOH solutions are reported as ppm (parts per million, which correspond more or less to milligrams per liter) of the various additives, expressed as elements. Thus, 100 ppm of TlCl (thallous chloride) are to indicate that the plating bath contains 117 ppm (about 117 milligrams per liter) of salt, corresponding to 100 ppm (about 100 milligrams per liter) of metal.

TABLE 1

| | Cathode Potentials vs. operating time | | | | | | | |
|---|---|---|---|---|---|---|---|---|
| | Additive to bath | | | Cathode Potential mV (NHE) | | | Impurity in 33% NaOH | |
| Coating | Element | Salt or Oxide | ppm | Initial | 1 day | 10 days | Element | ppm |
| Ni + $RuO_2$ | — | — | — | 1050 | 1050 | 1050 | — | — |
| Ni + $RuO_2$ | — | — | — | 1040 | 1060 | 1070 | Fe | 50 |
| Ni + $RuO_2$ | — | — | — | 1050 | 1150 | 1750 | Hg | 10 |
| Ni + $RuO_2$ | Tl | TlCl | 100 | 1050 | 1050 | 1050 | Fe | 50 |
| Ni + $RuO_2$ | Pb | $Pb(NO_3)_2$ | 100 | 1050 | 1050 | 1050 | Fe | 50 |
| Ni + $RuO_2$ | Sn | $SnCl_2$ | 100 | 1050 | 1050 | 1050 | Fe | 50 |
| Ni + $RuO_2$ | As | $As_2O_3$ | 100 | 1050 | 1050 | 1050 | Fe | 50 |
| Ni + $RuO_2$ | Sb | $Sb_2O_3$ | 100 | 1050 | 1050 | 1050 | Fe | 50 |
| Ni + $RuO_2$ | Bi | $Bi_2O_3$ | 100 | 1050 | 1050 | 1050 | Fe | 50 |
| Ni + $RuO_2$ | Tl | $TlCl_2$ | 100 | 1050 | 1050 | 1100 | Hg | 10 |
| Ni + $RuO_2$ | Pb | $Pb(NO_3)_2$ | 100 | 1040 | 1040 | 1080 | Hg | 10 |
| Ni + $RuO_2$ | Sn | $SnCl_2$ | 100 | 1040 | 1040 | 1090 | Hg | 10 |
| Ni + $RuO_2$ | As | $As_2O_3$ | 100 | 1040 | 1050 | 1090 | Hg | 10 |
| Ni + $RuO_2$ | Sb | $Sb_2O_3$ | 100 | 1040 | 1060 | 1120 | Hg | 10 |
| Ni + $RuO_2$ | Bi | $Bi_2O_3$ | 100 | 1040 | 1070 | 1130 | Hg | 10 |

Tests on the coating were carried out for a limited number of samples (destructive tests such as complete solubilization followed by colorimetric determination or by atomic absorption or non-destructive tests such as X-rays diffraction).

In those cases where the doping effect was due to lead addition, the coating was found to contain 100 to 1000 ppm of this element, depending on the stirring intensity, the other conditions being the same.

Similarly, the coatings doped by tin were found to contain small quantities of this element, in the range of 100 to 300 ppm. Higher contents were detected with a higher deposition temperature, for example 70° C. instead of 50°.

EXAMPLE 2

Nickel fabric samples made with a wire having a diameter of 0.1 mm, after suitable electrolytic pickling, have been activated, as illustrated in Example 1, by an electrocatalytic coating, utilizing a nickel plating Watt bath containing suspended particles of ruthenium oxide and dissolved salts of Pt, Pd, Cu, Ag, Au, as specified in Table 2.

The samples thus prepared were tested as cathodes at 90° C. under a current density of 3 kA/square meter, in 33% NaOH solutions either un-poisoned or respectively poisoned by 10 ppm of mercury. The results obtained are listed in the following Table 2.

TABLE 2

| | Cathode Potentials vs. operating time | | | | | | | |
|---|---|---|---|---|---|---|---|---|
| | Additive to bath | | | Cathode Potential mV (NHE) | | | Impurity in 33% NaOH | |
| Coating | Element | Salt | ppm | Initial | 1 day | 10 days | Element | ppm |
| Ni + $RuO_2$ | — | — | — | 1050 | 1050 | 1050 | — | — |
| Ni + $RuO_2$ | — | — | — | 1050 | 1150 | 1750 | Hg | 10 |
| Ni + $RuO_2$ | Pt | $PtCl_4$ | 0.01 | 1040 | 1040 | 1090 | Hg | 10 |
| Ni + $RuO_2$ | Pd | $PdCl_2$ | 0.01 | 1050 | 1050 | 1100 | Hg | 10 |
| Ni + $RuO_2$ | Cu | $CuCl_2$ | 0.01 | 1050 | 1050 | 1150 | Hg | 10 |
| Ni + $RuO_2$ | Ag | $AgCl(NH_3)_2$ | 0.01 | 1040 | 1040 | 1120 | Hg | 10 |
| Ni + $RuO_2$ | Au | $AuCl_3$ | 0.01 | 1040 | 1040 | 1180 | Hg | 10 |

EXAMPLE 3

Some cathodes were prepared following the procedures described in Example 2, with the only difference that mercury and iron salts were added to the nickel-plating baths, instead of the Pt, Pd, Cu, Ag and Au salts.

The cathodes were tested, under the same operating conditions of Example 2, for prolonged times, obtaining the results listed in Table 3, with 33% NaOH solutions poisoned respectively by iron (50 ppm) and mercury (10 ppm).

TABLE 3

| Coating | Cathode potentials vs. operating time: Additive to bath: Element | Salt | ppm | Cathode Potential mV (NHE): Initial | 1 day | 10 days | Impurity in 33% NaOH: Element | ppm |
|---|---|---|---|---|---|---|---|---|
| Ni + $RuO_2$ | — | — | — | 1050 | 1050 | 1050 | — | — |
| Ni + $RuO_2$ | — | — | — | 1040 | 1060 | 1070 | Fe | 50 |
| Ni + $RuO_2$ | — | — | — | 1050 | 1150 | 1750 | Hg | 10 |
| Ni + $RuO_2$ | Fe | $Fe(NO_3)_2$ + $(NH_4)_2SO_4$ weight ratio 1:10 | 1 | 1040 | 1060 | 1070 | Fe | 50 |
| Ni + $RuO_2$ | Fe | " | 10 | 1040 | 1060 | 1060 | Fe | 50 |
| Ni + $RuO_2$ | Fe | " | 100 | 1040 | 1060 | 1070 | Fe | 50 |
| Ni + $RuO_2$ | Hg | $Hg(NO_3)_2$ | 1 | 1050 | 1150 | 1450 | Hg | 10 |
| Ni + $RuO_2$ | Hg | " | 10 | 1040 | 1070 | 1150 | Hg | 10 |
| Ni + $RuO_2$ | Hg | " | 100 | 1040 | 1080 | 1250 | Hg | 10 |

EXAMPLE 4

Nickel fabric samples made of a wire having a diameter of 0.1 mm, after suitable electrolytic pickling, were activated, as illustrated in Example 1, by an electrocatalytic coating utilizing a nickel plating Watt bath containing suspended particles of ruthenium oxide and additives as per Table 4.

Then, the samples were tested as cathodes at 90° C., 3 KA/m2 in 33% NaOH solutions either unpoisoned or poisoned by iron (50 ppm) and mercury (10 ppm) and the relevant cathodic potentials versus time of electrolysis are collected in Table 4.

TABLE 4

| Coating | Cathode Potentials vs. operating time: Additive to bath: Element | Salt | ppm | Cathode Potential mV (NHE): Initial | 30 minutes | 60 minutes | Impurity in 33% NaOH: Element | ppm |
|---|---|---|---|---|---|---|---|---|
| Ni + $RuO_2$ | — | — | — | 1000 | 1000 | 1000 | — | — |
| Ni + $RuO_2$ | — | — | — | 1000 | 1080 | 1116 | Fe | 50 |
| Ni + $RuO_2$ | — | — | — | 1000 | 1800 | — | Hg | 10 |
| Ni + $RuO_2$ | Cd | $CdCl_2$ | 100 | 980 | 980 | 980 | — | — |
| Ni + $RuO_2$ | V | $VOCl_2$ | 1 | 1010 | 1010 | 1010 | — | — |
| Ni + $RuO_2$ | Mo | $Na_2MoO_4$ | 10 | 1020 | 1020 | 1020 | — | — |
| Ni + $RuO_2$ | Cd | $CdCl_2$ | 1 | 975 | 1320 | — | Hg | 10 |
| Ni + $RuO_2$ | Cd | $CdCl_2$ | 10 | 950 | 1270 | 1310 | Hg | 10 |
| Ni + $RuO_2$ | Cd | $CdCl_2$ | 100 | 980 | 1080 | 1090 | Hg | 10 |
| Ni + $RuO_2$ | V | $VOCl_2$ | 1 | 1010 | 1080 | 1110 | Fe | 50 |
| Ni + $RuO_2$ | V | $VOCl_2$ | 1 | 1000 | 1050 | 1105 | Hg | 10 |
| Ni + $RuO_2$ | V | $VOCl_2$ | 10 | 1010 | 1000 | 1200 | Hg | 10 |
| Ni + $RuO_2$ | Mo | $Na_2MoO_4$ | 10 | 1020 | 1020 | 1060 | Fe | 50 |
| Ni + $RuO_2$ | Mo | $Na_2MoO_4$ | 1 | 1020 | 1100 | 1250 | Hg | 10 |
| Ni + $RuO_2$ | Mo | $Na_2MoO_4$ | 5 | 1000 | 1080 | 1230 | Hg | 10 |
| Ni + $RuO_2$ | Mo | $Na_2MoO_4$ | 10 | 1010 | 1020 | 1090 | Hg | 10 |
| Ni + $RuO_2$ | Mo | $MoO_3$ | 1 | 980 | 1160 | 1190 | Hg | 10 |
| Ni + $RuO_2$ | Mo | $MoO_3$ | 5 | 980 | 1130 | 1140 | Hg | 10 |
| Ni + $RuO_2$ | Mo | $MoO_3$ | 10 | 945 | 1120 | 1160 | Hg | 10 |

EXAMPLE 5

Samples of nickel fabric were activated as illustrated in Example 1, the only difference being represented by the addition of various amounts of sodium thiosulphate as the doping additive.

The relevant data (added ppm, cathode potentials) are shown in Table 5.

TABLE 5

| Coating | Cathode Potentials vs. operating time: Additive to bath: Element | Salt | ppm | Cathode Potential mV (NHE): Initial | 30 minutes | 60 minutes | Impurity in 33% NaOH: Element | ppm |
|---|---|---|---|---|---|---|---|---|
| Ni + $RuO_2$ | — | — | — | 940 | 980 | 980 | — | — |
| Ni + $RuO_2$ | — | — | — | 1000 | 1090 | 1150 | Fe | 50 |
| Ni + $RuO_2$ | — | — | — | 980 | 2000 | — | Hg | 10 |
| Ni + $RuO_2$ | S | $Na_2S_2O_3$ | 10 | 990 | 1000 | 1040 | Fe | 50 |
| Ni + $RuO_2$ | S | $Na_2S_2O_3$ | 100 | 990 | 1000 | 1020 | Fe | 50 |
| Ni + $RuO_2$ | S | $Na_2S_2O_3$ | 500 | 960 | 960 | 960 | Fe | 50 |
| Ni + $RuO_2$ | S | $Na_2S_2O_3$ | 10 | 970 | 1600 | — | Hg | 10 |
| Ni + $RuO_2$ | S | $Na_2S_2O_3$ | 25 | 970 | 1550 | — | Hg | 10 |
| Ni + $RuO_2$ | S | $Na_2S_2O_3$ | 50 | 970 | 1500 | — | Hg | 10 |
| Ni + $RuO_2$ | S | $Na_2S_2O_3$ | 100 | 950 | 1100 | 1580 | Hg | 10 |
| Ni + $RuO_2$ | S | $Na_2S_2O_3$ | 500 | 940 | 1050 | 1200 | Hg | 10 |
| Ni + $RuO_2$ | S | $Na_2S_2O_3$ | 1000 | 980 | 1030 | 1180 | Hg | 10 |
| Ni + $RuO_2$ | S | $Na_2S_2O_3$ | 500 | 940 | 940 | 940 | — | — |

EXAMPLE 6

Nickel fabric samples made of a wire having a diameter of 0.1 mm, after suitable electrolytic pickling, were activated, as illustrated in Example 1, by a nickel plating Watt bath containing suspended particles of ruthenium oxide and dissolved compounds of more than one doping element according to the present invention, as listed in Table 6 which shows also the values relating to the electrolysis carried out at 90° C., 3 kA/square meter in 33% NaOH solutions poisoned respectively by iron (50 ppm) and mercury (10 ppm).

TABLE 6

| | Cathode potentials vs. operating time | | | | | | | |
|---|---|---|---|---|---|---|---|---|
| | Additive to bath | | | Cathode Potential mV (NHE) | | | Impurity in 33% NaOH | |
| Coating | Element | Salt or Oxide | ppm | Initial | 1 day | 10 days | Element | ppm |
| Ni + $RuO_2$ | — | — | — | 1050 | 1050 | 1050 | — | — |
| Ni + $RuO_2$ | — | — | — | 1040 | 1060 | 1070 | Fe | 50 |
| Ni + $RuO_2$ | — | — | — | 1050 | 1150 | 1750 | Hg | 10 |
| Ni + $RuO_2$ | Sb + S | $Sb_2O_3$ | 100 | 1040 | 1050 | 1040 | Fe | 50 |
| | | $Na_2S$ | 100 | | | | | |
| Ni + $RuO_2$ | Cd + Mo | $Cd(NO_3)_2$ | 100 | 1040 | 1040 | 1040 | Fe | 50 |
| | | $MoO_3$ | 100 | | | | | |
| Ni + $RuO_2$ | Sb + S | $Sb_2O_3$ | 100 | 1040 | 1050 | 1100 | Hg | 10 |
| | | $Na_2S$ | 100 | | | | | |
| Ni + $RuO_2$ | Bi + Se | $Bi(NO_3)_3$ | 100 | 1040 | 1060 | 1100 | Hg | 10 |
| | | $SeO_2$ | 100 | | | | | |

EXAMPLE 7

Nickel fabric samples made of a wire having a diameter of 0.1 mm, after suitable electrolytic pickling, were activated by an electrocatalytic coating of nickel-ruthenium utilizing a Watt nickel plating bath containing ruthenium trichloride ($RuCl_3$) in a ratio of 1 g/l as ruthenium, and doping additives, as illustrated in Table 7. The deposition conditions were those described in Example 1.

The samples thus obtained were then utilized as cathodes at 90° C., 3 kA/square meter, in 33% NaOH solutions poisoned by iron (50 ppm) and mercury (10 ppm) respectively.

TABLE 7

| | Cathode Potentials vs. operating time | | | | | | | |
|---|---|---|---|---|---|---|---|---|
| | Additive to bath | | | Cathode Potential mV (NHE) | | | Impurity in 33% NaOH | |
| Coating | Element | Salt | ppm | Initial | 1 day | 10 days | Element | ppm |
| Ni – Ru | — | — | — | 1090 | 1090 | 1090 | — | — |
| Ni – Ru | — | — | — | 1090 | 1180 | 1180 | Fe | 50 |
| Ni – Ru | — | — | — | 1100 | 1650 | 2100 | Hg | 10 |
| Ni – Ru | Tl | TlCl | 100 | 1090 | 1110 | 1150 | Fe | 50 |
| Ni – Ru | Pb | $Pb(NO_3)_2$ | 100 | 1100 | 1100 | 1110 | Fe | 50 |
| Ni – Ru | Sn | $SnCl_2$ | 100 | 1100 | 1110 | 1130 | Fe | 50 |
| Ni – Ru | As | $As_2O_3$ | 100 | 1100 | 1110 | 1120 | Fe | 50 |
| Ni – Ru | Sb | $Sb_2O_3$ | 100 | 1100 | 1110 | 1150 | Fe | 50 |
| Ni – Ru | Bi | $Bi_2O_3$ | 100 | 1090 | 1090 | 1120 | Fe | 50 |
| Ni – Ru | Tl | TlCl | 100 | 1090 | 1380 | 1750 | Hg | 10 |
| Ni – Ru | Pb | $Pb(NO_3)_2$ | 100 | 1090 | 1490 | 1750 | Hg | 10 |
| Ni – Ru | Sn | $SnCl_2$ | 100 | 1100 | 1510 | 1780 | Hg | 10 |
| Ni – Ru | As | $As_2O_3$ | 100 | 1100 | 1420 | 1820 | Hg | 10 |
| Ni – Ru | Sb | $Sb_2O_3$ | 100 | 1100 | 1600 | 1980 | Hg | 10 |
| Ni – Ru | Bi | $Bi_2O_3$ | 100 | 1090 | 1590 | 1870 | Hg | 10 |

EXAMPLE 8

Nickel-ruthenium coatings were obtained as described in Example 7, the only difference being the nature of the doping additives which were the same utilized in Example 4.

The same results of Example 4 were obtained.

EXAMPLE 9

Following the same procedure illustrated in Example 7, nickel fabric samples were activated but, unlike Example 8, salts of Pt, Pd, Cu, Ag, Au were added to the galvanic bath containing $RuCl_3$, as shown in Table 7, which collects the various cathodic potentials detected at 90° C., 3 kA/square meter, in 33% NaOH solutions poisoned by 10 ppm of mercury.

TABLE 8

| | Cathode Potentials vs. operating time | | | | | | | |
|---|---|---|---|---|---|---|---|---|
| | Additive to bath | | | Cathode Potential mV (NHE) | | | Impurity in 33% NaOH | |
| Coating | Element | Salt | ppm | Initial | 1 day | 10 days | Element | ppm |
| Ni – Ru | — | — | — | 1100 | 1090 | 1100 | — | — |
| Ni – Ru | — | — | — | 1100 | 1650 | 2100 | Hg | 10 |
| Ni – Ru | Pt | $PtCl_4$ | 0.01 | 1100 | 1150 | 1160 | Hg | 10 |
| Ni – Ru | Pd | $PdCl_2$ | 0.01 | 1100 | 1150 | 1170 | Hg | 10 |
| Ni – Ru | Cu | $CuCl_2$ | 0.01 | 1100 | 1140 | 1150 | Hg | 10 |
| Ni – Ru | Ag | $AgCl(NH_3)_2$ | 0.01 | 1100 | 1060 | 1180 | Hg | 10 |
| Ni – Ru | Au | $AuCl_3$ | 0.01 | 1100 | 1060 | 1060 | Hg | 10 |

I claim:

1. A method for electrolyzing an alkali metal chloride solution which comprises providing an electrolytic cell comprising an anode and a cathode separated by an ion exchange membrane that is substantially impermeable to electrolyte flow, wherein said cathode comprises (a) an electroconductive support, and (b) an electrocatalytic coating of a metal or metal alloy with particles of electrocatalytic materials dispersed therein and being prepared by depositing said electrocatalytic coating by galvanic deposition onto said electroconductive support from a galvanic plating both containing suspended particles of said electrocatalytic materials and small amounts effective to inhibit the poisoning of said cathode by metal impurities present in the catholyte of at least one additional compound of elements selected from the group of the periodic table of IB, IIB, IIIA, IVA, VA, VB, VIA, VIB, and VIII; and wherein the catholyte is an alkali metal hydroxide solution contaminated by metal impurities; and passing an electrical current from the anode to the cathode.

2. The method of claim 1 wherein the amount of said additional compound is 0.005 to 2000 ppm.

3. The method of claim 1 wherein said additional compound is selected from the group of IB and VIII of the Periodic Table.

4. The method of claim 1 wherein said additional compound is selected from the group of IIB, IIIA, IVA, VA, and VB of the Periodic Table.

5. The method of claim 4 wherein the amount of said additional compound is up to 500 ppm.

6. The method of claim 1 wherein said additional compound belongs to the VIB group of the Periodic Table.

7. The method of claim 6 wherein the amount of said additional compound is up to 100 ppm.

8. The method of claim 1 wherein said additional compound belongs to group VIA of the Periodic Table.

9. The method of claim 8 wherein the amount of said additional compound is up to 2000 ppm.

10. The method of claim 1 wherein said electrocatalytic coating contains a metal or a metal alloy containing metals of the platinum group as a homogeneous phase.

11. The method of claim 10 wherein the amount of said additional compound is 0.005 to 2000 ppm.

12. The method of claim 10 wherein said additional compound is selected from the group of IB and VIII of the Periodic Table.

13. The method of claim 10 wherein said additional compound is selected from the group of IIB, IIIA, IVA, VA, and VB of the Periodic Table.

14. The method of claim 13 wherein the amount of said additional compound is up to 500 ppm.

15. The method of claim 10 wherein said additional compound belongs to the VIB group of the Periodic Table.

16. The method of claim 15 wherein the amount of said additional compound is up to 100 ppm.

17. The method of claim 10 wherein said additional compound belongs to group VIA of the Periodic Table.

18. The method of claim 17 wherein the amount of said additional compound is up to 2000 ppm.

19. The method of claim 1 wherein the additional compound of the elements of group IB is a compound of silver.

20. The method of claim 1 wherein the additional compound of elements of group IIB is a compound of cadmium or mercury.

21. The method of claim 1 wherein the additional compound of elements of group IIIA is a compound of thallium.

22. The method of claim 1 wherein the additional compound of elements of group IVA is a compound of lead.

23. The method of claim 1 wherein the additional compound of elements of group VA is a compound of arsenic.

24. The method of claim 1 wherein the additional compound of elements of group VB is a compound of vanadium.

25. The method of claim 1 wherein the additional compound of elements of group VIA is a compound of sulphur.

26. The method of claim 1 wherein the additional compound of elements of group VIB is a compound of molybdenum.

27. The method of claim 1 wherein the additional compound of elements of group VIII is a compound of platinum or palladium.

28. The method of claim 1 wherein the electrocatalytic material of the suspended particles include ruthenium oxide.

29. A method for galvanically preparing an electrode for electrochemical processes, said electrode being of the type comprising (a) an electroconductive support and (b) an electrocatalytic coating of a metal or metal alloy with particles of electrocatalytic materials dispersed therein; said method consisting in applying said electrocatalytic coating by galvanic deposition onto said electroconductive support from a galvanic plating bath containing suspended particles of said electrocatalytic materials, characterized in that said galvanic plating bath further contains 0.005 to 2000 ppm of at least one additional compound of elements selected from the group of VA of the Periodic Table, group VB of the Periodic Table, group VIA of the Periodic Table, cadmium, mercury, thallium, lead, and molybdenum.

30. The method of claim 29 wherein the additional compound of elements of group VA is a compound of arsenic.

31. The method of claim 29 wherein the additional compound of elements of group VB is a compound of vanadium.

32. The method of claim 31 wherein the additional compound of elements of group VIA is a compound of sulphur.

33. A method for galvanically preparing an electrode for electrochemical processes, said electrode of the type comprising (a) an electroconductive support and (b) an electrocatalytic coating of a metal or a metal alloy containing metals of the platinum group as a homogeneous phase, said method consisting in applying said electrocatalytic coating by galvanic deposition on said electroconductive support from a galvanic plating bath containing soluble salts of metals of the platinum group dissolved therein, characterized in that said galvanic plating bath further contains 0.005 to 2000 ppm of at least one additional compound of elements selected from the group VA of the Periodic Table, group VB of the Periodic Table, group VIA of the Periodic Table, gold, cadmium, thallium, lead, and molybdenum.

34. The method of claim 33 characterized in that the additional compound of elements of group VA is a compound of arsenic.

35. The method of claim 33 characterized in that the additional compound of elements of group VB is a compound of vanadium.

* * * * *